US009581391B2

(12) United States Patent
Ohtani et al.

(10) Patent No.: US 9,581,391 B2
(45) Date of Patent: Feb. 28, 2017

(54) AIR CONDITIONING APPARATUS

(71) Applicant: DAIKIN INDUSTRIES, LTD., Osaka-shi, Osaka (JP)

(72) Inventors: Yasutaka Ohtani, Sakai (JP); Yoshio Oritani, Sakai (JP); Takuya Kazusa, Sakai (JP); Masanori Jindou, Sakai (JP); Junichi Hamadate, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 277 days.

(21) Appl. No.: 14/365,995

(22) PCT Filed: Nov. 30, 2012

(86) PCT No.: PCT/JP2012/081064
§ 371 (c)(1),
(2) Date: Jun. 16, 2014

(87) PCT Pub. No.: WO2013/094386
PCT Pub. Date: Jun. 27, 2013

(65) Prior Publication Data

US 2015/0068709 A1 Mar. 12, 2015

(30) Foreign Application Priority Data

Dec. 22, 2011 (JP) ..... 2011-280825

(51) Int. Cl.
*F28F 21/08* (2006.01)
*F28D 7/00* (2006.01)
(Continued)

(52) U.S. Cl.
CPC ..... *F28D 7/00* (2013.01); *F24F 1/16* (2013.01); *F24F 1/18* (2013.01); *F24F 1/30* (2013.01);
(Continued)

(58) Field of Classification Search
CPC ..... F28D 1/05383; F28D 1/05375; F28D 1/05358; F28D 1/05341; F28D 1/05325;
(Continued)

(56) References Cited

U.S. PATENT DOCUMENTS 5,279,360 A * 1/1994 Hughes ..... F25B 39/02 165/111
5,607,291 A * 3/1997 Morita ..... F04B 39/123 417/410.1
(Continued)

FOREIGN PATENT DOCUMENTS

JP 3-211398 A 9/1991
JP 4-359797 A 12/1992
(Continued)

OTHER PUBLICATIONS

European Search Report of corresponding EP Application No. 12 85 8747.4 dated Oct. 28, 2014.
(Continued)

*Primary Examiner* — Tho V Duong
(74) *Attorney, Agent, or Firm* — Global IP Counselors

(57) ABSTRACT

An air conditioning apparatus includes an aluminum heat exchanger, an aluminum gas pipe, an aluminum liquid pipe and a copper gas pipe. The aluminum heat exchanger performs heat exchange between air and a refrigerant, and is disposed upright. The aluminum gas pipe channels gas refrigerant, and extends from a side part of the aluminum heat exchanger. The aluminum liquid pipe channels liquid refrigerant, and extends from an area below the aluminum gas pipe in the side part of the aluminum heat exchanger. The copper gas pipe channels gas refrigerant. The aluminum gas pipe is connected in a connecting part to the copper gas pipe from above the copper gas pipe. The aluminum pipe is
(Continued)

disposed in an area outside of directly under the connecting part of the aluminum gas pipe and the copper gas pipe.

4 Claims, 9 Drawing Sheets

(51) Int. Cl.

| | |
|---|---|
| ***F24F 1/16*** | (2011.01) |
| ***F24F 1/18*** | (2011.01) |
| ***F24F 1/30*** | (2011.01) |
| ***F28F 17/00*** | (2006.01) |
| ***F28F 19/00*** | (2006.01) |
| ***F28F 1/12*** | (2006.01) |
| *F25B 13/00* | (2006.01) |

(52) U.S. Cl.
CPC ..... *F28F 1/128* (2013.01); *F28F 17/005* (2013.01); *F28F 19/00* (2013.01); *F28F 21/084* (2013.01); *F28F 21/085* (2013.01); *F25B 13/00* (2013.01); *F28F 2215/12* (2013.01)

(58) Field of Classification Search
CPC .... F28D 1/05316; F28D 1/05308; F28D 7/00; F24F 1/28; F24F 1/32; F24F 1/26; F24F 1/18; F24F 1/16; F24F 17/00; F28F 19/00; F28F 2215/12; F28F 21/085; F25B 13/00
USPC ..... 165/175, 176, 178
See application file for complete search history.

(56) References Cited

U.S. PATENT DOCUMENTS

| | | | | | |
|---|---|---|---|---|---|
| 5,632,332 | A * | 5/1997 | Hanafusa | F28F 9/002 | 165/153 |
| 6,125,646 | A * | 10/2000 | Ebner | B60H 1/00521 | 165/178 |
| 6,470,703 | B2 * | 10/2002 | Wada | F25B 39/04 | 165/110 |
| 2007/0284086 | A1 * | 12/2007 | Matter | F28F 9/0246 | 165/104.11 |
| 2012/0118532 | A1 * | 5/2012 | Jentzsch | F28F 9/002 | 165/67 |

FOREIGN PATENT DOCUMENTS

| | | | |
|---|---|---|---|
| JP | 6-300303 | A | 10/1994 |
| JP | 11183075 | A * | 7/1999 |
| JP | 2009-68785 | A | 4/2009 |
| JP | 2009-092274 | A | 4/2009 |
| WO | 2012/120554 | A1 | 9/2012 |

OTHER PUBLICATIONS

International Preliminary Report of corresponding PCT Application No. PCT/JP2012/081064 dated Jul. 3, 2014.
International Search Report of corresponding PCT Application No. PCT/JP2012/081064.

* cited by examiner

AIR CONDITIONING APPARATUS

CROSS-REFERENCE TO RELATED APPLICATIONS

This U.S. National stage application claims priority under 35 U.S.C. §119(a) to Japanese Patent Application No. 2011-280825, filed in Japan on Dec. 22, 2011, the entire contents of which are hereby incorporated herein by reference.

TECHNICAL FIELD

The present invention relates to an air conditioning apparatus, and particularly relates to an air conditioning apparatus comprising an aluminum heat exchanger.

BACKGROUND ART

Recently there has been use of aluminum and/or aluminum alloys not only in the tins of heat exchangers, but also in the heat transfer tubes and/or the header pipes of heat exchangers, in order to reduce the weight of heat exchangers. Heat exchangers in which aluminum and/or an aluminum alloy are used for the fins, heat transfer tubes, and header pipes are referred to below as aluminum heat exchangers. Piping made from copper and/or a copper alloy (referred to below as copper piping) is used as piping for circulating refrigerant in aluminum heat exchangers.

In a heat exchanger for performing heat exchange between air and a refrigerant, the components of the heat exchanger have a lower temperature than the dew-point temperature of air, and dew condensation often occurs due to the moisture in the air. If dew condensation occurs in copper piping, there will be copper ions in the dew condensation water. When dew condensation water containing copper ions gets on an aluminum heat exchanger, it could lead to corrosion. Therefore, there are cases in which a falling water droplet preventative piping section inclined downward from the heat exchanger toward the refrigerant line is provided in order to prevent dew condensation water containing copper ions from dripping down onto the aluminum heat exchanger, as is indicated in Japanese Laid-open Patent Application No. 6-300303.

SUMMARY

Technical Problem

When copper and/or a copper alloy, which has a small tendency to ionize, is directly connected to aluminum and/or an aluminum alloy, which has a large tendency to ionize, corrosion advances readily in the aluminum members because of the difference in ionization tendency, and it is therefore preferable not to directly connect copper piping to header pipes made of aluminum and/or an aluminum alloy. In such cases, the copper piping is connected to a gas pipe (referred to as an aluminum gas pipe below) and/or a liquid pipe (referred to as an aluminum liquid pipe below) which are made of aluminum and/or an aluminum alloy and which are drawn out of aluminum header pipes.

With an outdoor heat exchanger of an air conditioning apparatus. For example, when the heat exchanger functions as an evaporator of refrigerant during a heating operation, comparatively low-temperature gas refrigerant flows in through a gas pipe of the outdoor heat exchanger, and there are cases in which moisture condenses on the surface of the gas pipe. Therefore, it is not enough merely to prevent dew condensation water containing copper ions from dripping down onto the aluminum heat exchanger, and portions of contact between aluminum pipes and copper piping should be designed while taking heed of water droplets and the like that could fall from copper piping positioned in spaces above aluminum pipes.

An object of the present invention is to prevent corrosion of an aluminum liquid pipe and/or an aluminum gas pipe extending from an aluminum heat exchanger.

Solution to Problem

An air conditioning apparatus according to a first aspect of the present invention comprises: an aluminum heat exchanger for performing heat exchange between air and a refrigerant, the heat exchanger being disposed upright; an aluminum gas pipe for channeling gas refrigerant, the aluminum gas pipe extending from a side part of the aluminum heat exchanger; an aluminum liquid pipe for channeling liquid refrigerant, the aluminum liquid pipe extending from an area below the aluminum gas pipe in the side part of the aluminum heat exchanger; and a copper gas pipe for channeling gas refrigerant; the aluminum gas pipe being connected in a connecting part to the copper gas pipe from above the copper gas pipe; and the aluminum liquid pipe being disposed in an area outside of directly under the connecting part of the aluminum gas pipe and the copper gas pipe.

The concept of the area directly below the connecting part of the aluminum gas pipe and the copper gas pipe includes the area directly below the bottom end of the copper gas pipe when the pipe is inclined. In other words, the area directly below the bottom end of the copper gas pipe is not equivalent to the area outside of directly under.

The concept of the aluminum members includes members made of aluminum or an aluminum alloy, and the concept of the copper members includes members made of copper or a copper alloy. The concept of these members also includes heat exchangers, the structural components or various pipes thereof, and the like.

In the air conditioning apparatus according to the first aspect, because the aluminum gas pipe is connected from above the copper gas pipe, dew condensation water containing copper ions forming by dew condensation on the copper gas pipe does not get on the aluminum gas pipe by running down the gas pipe below. Because the aluminum liquid pipe is not disposed directly below the part connecting with the copper gas pipe, dew condensation water containing copper ions forming on the copper gas pipe does not readily get on the aluminum liquid pipe as well. This prevents the progress of corrosion of the aluminum gas pipe and the aluminum liquid pipe caused by dew condensation water containing copper ions forming on the copper gas pipe.

An air conditioning apparatus according to a second aspect of the present invention is the air conditioning apparatus according to the first aspect, further comprising a copper liquid pipe for channeling liquid refrigerant, the aluminum liquid pipe having a first turn-back part extending upward from the side part of the aluminum heat exchanger and then forming a U-turn to extend downward, and the copper liquid pipe being connected to an end of the first turn-back part from below.

In the air conditioning apparatus according to the second aspect, the first turn-back part of the aluminum liquid pipe makes it possible to prevent water droplets spreading over the copper liquid pipe from reaching the aluminum heat exchanger, and it is possible to prevent corrosion of the aluminum heat exchanger by water containing copper ions that spreads of the copper liquid pipe.

An air conditioning apparatus according to a third aspect of the present invention is the air conditioning apparatus according to the second aspect, wherein the aluminum gas pipe extends in the same direction in which the aluminum liquid pipe extends, and has a second turn-back part extending upward from the side part of the aluminum heat exchanger and then forming a U-turn to extend downward, the copper as pipe being connected to the end of the second turn-back part from below, and the second turn-back part being disposed in an orientation that intersects the first turn-back part in a plan view.

In the air conditioning apparatus according to the third aspect, due to the second turn-back part of the aluminum gas pipe and the first turn-back part being disposed in intersecting orientations, the aluminum gas pipe, the aluminum liquid pipe, the copper gas pipe and the copper liquid pipe can be kept within the range of the vertical length of the heat exchanger while preventing corrosion of the aluminum liquid pipe caused by dripping of water droplets containing copper ions.

An air conditioning apparatus according to a fourth aspect of the present invention is the air conditioning apparatus according to any of the first through third aspects, wherein the aluminum heat exchanger has a plurality of aluminum flat pipes, a header pipe to which the aluminum flat pipes are connected, and a plurality of aluminum fins bonded to the flat pipes, the heat exchanger being configured so that fluid flowing inside the flat pipes exchanges heat with air flowing over the exterior of the flat pipes; the aluminum gas pipe is connected to the middle vicinity of the top part of the header pipes; and the aluminum liquid pipe is connected to the bottom part of the header pipe.

In the air conditioning apparatus according to the fourth aspect, the plurality of aluminum flat pipes may be arrayed so that the side surfaces face each other.

In the air conditioning apparatus according to the fourth aspect, due to the aluminum gas pipe being connected to the middle vicinity of the top part of the header pipe, the heat exchanger can be made more compact while preventing corrosion of the aluminum gas pipe, and uneven flow in the heat exchanger is easily prevented.

Advantageous Effects of Invention

In the air conditioning apparatus according to the first aspect, it is possible to prevent corrosion by water containing copper ions in the aluminum liquid pipe extending from the aluminum heat exchanger.

In the air conditioning apparatus according to the second aspect, it is possible to prevent corrosion by water containing copper ions not only in the aluminum liquid pipe, but also in the aluminum heat exchanger to which the aluminum liquid pipe is linked.

In the air conditioning apparatus according to the third aspect, the air conditioning apparatus can be made more compact while preventing corrosion by water containing copper ions in the aluminum liquid pipe and gas pipe extending from the aluminum heat exchanger.

In the air conditioning apparatus according to the fourth aspect, the performance of the air conditioning apparatus can be improved by preventing drift of refrigerant flow, while corrosion by water containing copper ions is prevented in the aluminum liquid pipe and gas pipe extending from the aluminum heat exchanger.

DESCRIPTION OF EMBODIMENTS

(1) Overall Configuration of Air Conditioning Apparatus

Figure 1:
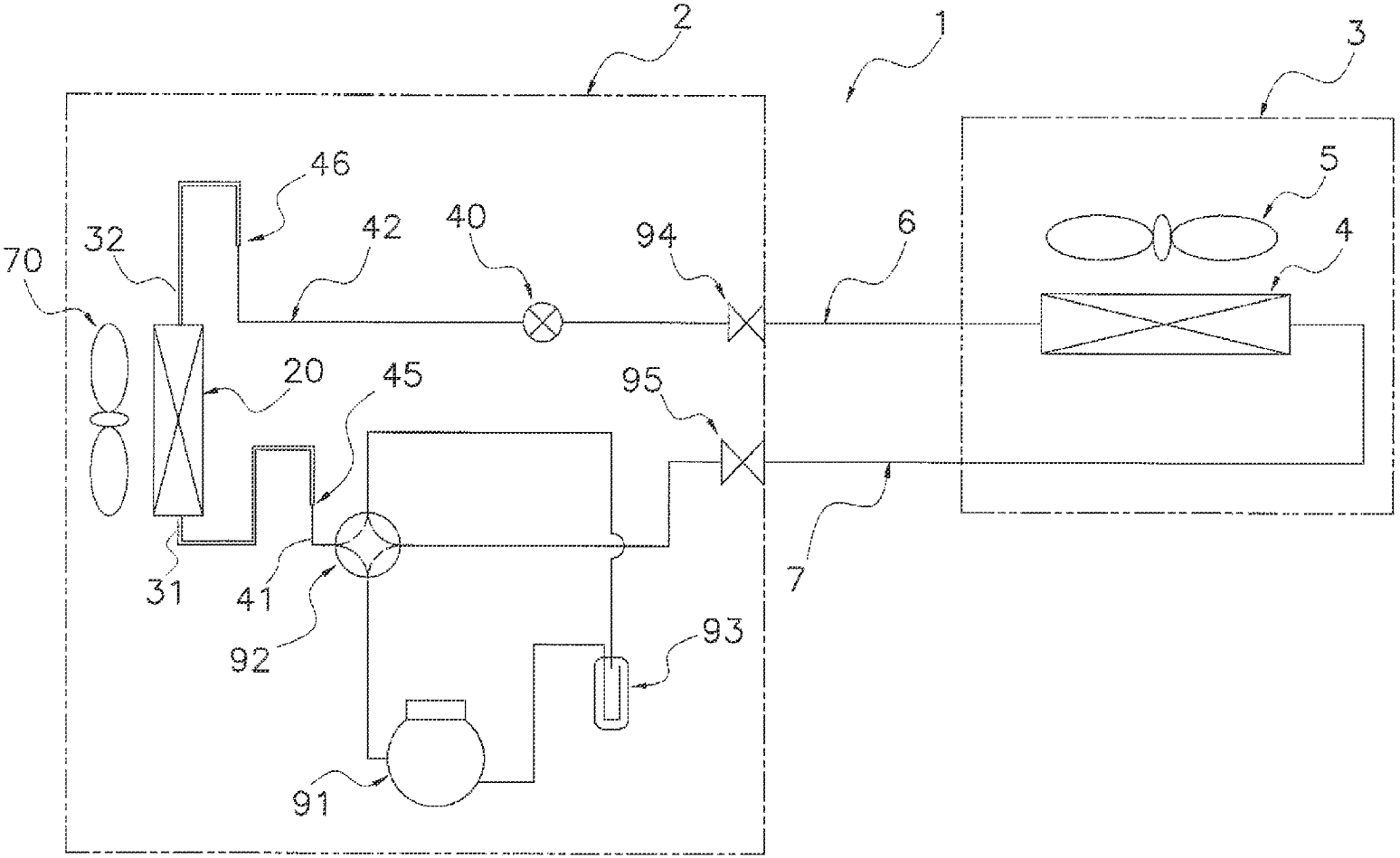
FIG. 1 is a circuit diagram for describing a summary of the configuration of an air conditioning apparatus according to an embodiment.

FIG. 1 is a circuit diagram showing an overview of the configuration of an air conditioning apparatus according to an embodiment of the present invention. An air conditioning apparatus 1 is configured from an outdoor unit 2 of the air conditioning apparatus (a heat-source-side unit) and an indoor unit 3 of the air conditioning apparatus (a usage-side unit). This air conditioning apparatus 1 is an apparatus used to cool and heat the air in the building where the indoor unit 3 is installed, by performing a vapor-compression refrigeration cycle operation. The air conditioning apparatus 1 comprises the outdoor unit 2 as a heat-source unit, the indoor unit 3 as a usage unit, and refrigerant communication pipes 6, 7 connecting the outdoor unit 2 and the indoor unit 3.

The refrigeration circuit configured by a network of the outdoor unit 2, the indoor unit 3, and the refrigerant communication pipes 6, 7 has a configuration in which components such as a compressor 91, a four-way valve 92, an outdoor heat exchanger 20, an expansion valve 40, an indoor heat exchanger 4, and an accumulator 93 are connected by refrigerant line. Refrigerant is enclosed within this refrigeration circuit, and a refrigeration cycle operation is performed in which the refrigerant is compressed, cooled, depressurized, heated, evaporated, and then compressed again. Possible options for the refrigerant include R410A, R407C, R22, R134a, carbon dioxide, and the like, for example.

(2) Action of Air Conditioning Apparatus (2-1) Cooling Operation

During a cooling operation, the four-way valve 92 is in the state depicted by the solid lines in FIG. 1, i.e., in a state in which the discharge side of the compressor 91 is connected to the gas side of the outdoor heat exchanger 20, and the intake side of the compressor 91 is connected to the gas side of the indoor heat exchanger 4 via an accumulator 93, a gas-refrigerant-side shutoff valve 95, and a refrigerant communication pipe 7. The opening degree of the expansion valve 40 is adjusted so that the degree of superheat of the refrigerant in the outlet of the indoor heat exchanger 4 (i.e. the gas side of the indoor heat exchanger 4) remains constant. When the compressor 91, an outdoor fan 70, and an indoor fan 5 are operated in this state of the refrigeration circuit, low-pressure gas refrigerant is drawn into the compressor 91 and compressed to high-pressure gas refrigerant. This high-pressure gas refrigerant is fed through the four-way valve 92, a copper gas refrigerant pipe 41, and an aluminum heat-exchanger-side gas pipe 31 to the outdoor heat exchanger 20. The high-pressure gas refrigerant then undergoes heat exchange in the outdoor heat exchanger 20 with outside air supplied by the outdoor fan 70, and the refrigerant condenses to high-pressure liquid refrigerant. The high-pressure liquid refrigerant, which is in a supercooled state, is sent from the outdoor heat exchanger 20, through an aluminum heat-exchanger-side liquid pipe 32 and a copper liquid refrigerant pipe 42, to the expansion valve 40. The refrigerant is depressurized by the expansion valve 40 nearly to the intake pressure of the compressor 91, becoming a low-pressure gas-liquid two-phase refrigerant, which is sent to the indoor heat exchanger 4 and evaporated to a low-pressure gas refrigerant by heat exchange with indoor air in the indoor heat exchanger 4.

This low-pressure gas refrigerant is fed through the refrigerant communication pipe 7 to the outdoor unit 2, and is drawn back into the compressor 91 via the gas-refrigerant-side shutoff valve 95 and the four-way valve 92. Thus, in the cooling operation, the air conditioning apparatus 1 causes the outdoor heat exchanger 20 to function as a condenser of the refrigerant compressed in the compressor 91, and the indoor heat exchanger 4 to function as an evaporator of the refrigerant condensed in the outdoor heat exchanger 20.

(2-2) Heating Operation

During the heating operation, the four-way valve 92 is in the state depicted by the broken lines in FIG. 1, i.e., a state in which the discharge side of the compressor 91 is connected to the gas side of the indoor heat exchanger 4 via the gas-refrigerant-side shutoff valve 95 and the refrigerant communication pipe 7, and the intake side of the compressor 91 is connected to the gas side of the outdoor heat exchanger 20. A liquid-refrigerant-side shutoff valve 94 and the gas-refrigerant-side shutoff valve 95 are in an open state. The opening degree of the expansion valve 40 is adjusted so that the degree of supercooling of the refrigerant in the outlet of the indoor heat exchanger 4 remains constant at a degree of supercooling target value. When the compressor 91, the outdoor fan 70, and the indoor fan 5 are operated with the refrigeration circuit in this state, low-pressure gas refrigerant is drawn into the compressor 91 and compressed to high-pressure gas refrigerant, and then fed through the four-way valve 92, the gas-refrigerant-side shutoff valve 95, and the refrigerant communication pipe 7 to the indoor unit 3.

The high-pressure gas refrigerant sent to the indoor unit 3 undergoes heat exchange with indoor air in the indoor heat exchanger 4, and the refrigerant condenses to high-pressure liquid refrigerant which during subsequent passage through the expansion valve 40 is depressurized according to the opening degree of the expansion valve 40. The refrigerant passing through the expansion valve 40 flows through the copper liquid refrigerant pipe 42 and the heat-exchanger-side liquid pipe 32 into the outdoor heat exchanger 20. The low-pressure gas-liquid two-phase refrigerant flowing into the outdoor heat exchanger 20 undergoes heat exchange with outside air supplied by the outdoor fan 70 and evaporates to low-pressure gas refrigerant, which is drawn through the aluminum heat-exchanger-side gas pipe 31, the copper gas refrigerant pipe 41, and the four-way valve 92 back into the compressor 91. Thus, in the heating operation, the air conditioning apparatus 1 causes the indoor heat exchanger 4 to function as a condenser of the refrigerant compressed in the compressor 91, and the outdoor heat exchanger 20 to function as an evaporator of the refrigerant condensed in the indoor heat exchanger 4.

Because this gas refrigerant evaporated in the outdoor heat exchanger 20 is lower in temperature than the indoor air, dew condensation occurs readily not only on the outdoor heat exchanger 20, but also on the aluminum heat-exchanger-side gas pipe 31 and/or the copper gas refrigerant pipe 41.

(3) Detailed Configuration of Air Conditioning Apparatus (3-1) Indoor Air Conditioning Unit The indoor unit 3 is installed by being hung from an interior wall surface, or by being flush-mounted in or suspended from an interior ceiling of a building or the like. The indoor unit 3 has the indoor heat exchanger 4 and the indoor fan 5. The indoor heat exchanger 4 is, for example, a fin-and-tube heat exchanger of cross-fin type constituted by heat transfer tubes and a multitude of fins. During cooling operation, the heat exchanger 4 functions as an evaporator for the refrigerant, to cool the interior air, and during heating operation functions as a condenser for the refrigerant, to heat the interior air.

(3-2) Outside Air Conditioning Unit

Figure 2:
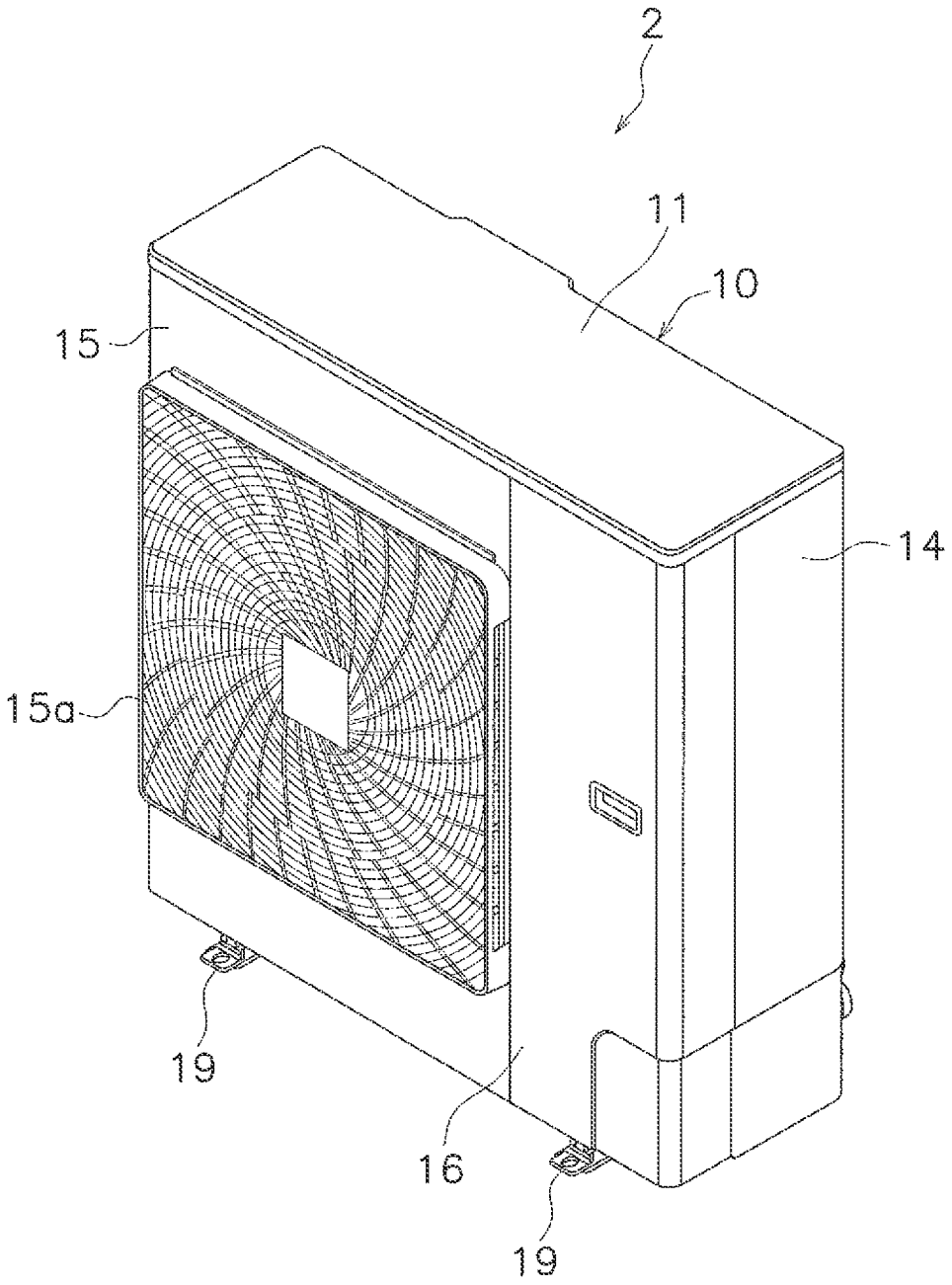
FIG. 2 is a perspective view showing an external view of an outdoor unit of the air conditioning apparatus.
Figure 3:
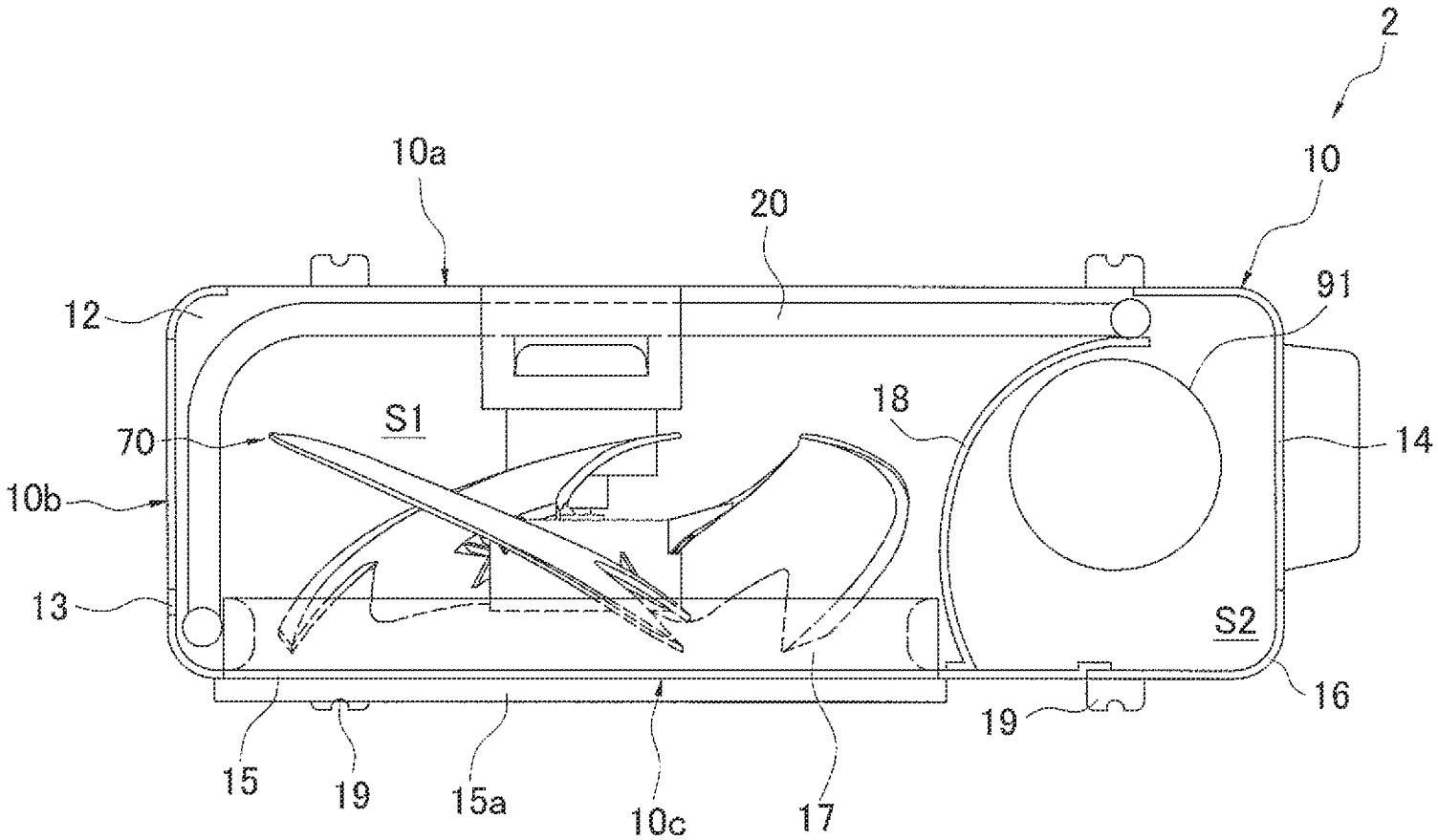
FIG. 3 is a schematic cross-sectional view for describing a summary of the placement of the devices of the outdoor unit.

The outdoor unit 2 is installed on the outside of a building or the like, and is connected to the indoor unit 3 via the refrigerant communication pipes 6, 7. The outdoor unit 2 comprises a substantially rectangular parallelepiped unit casing 10 as depicted in FIGS. 2 and 3. The outdoor unit 2 has a structure in which a blower compartment S1 and an machine compartment S2 are formed by the internal space of the unit casing 10 being divided in two by a vertically extending partitioning plate 18 ("trunk" structure), as depicted in FIG. 3.

The unit casing 10 is configured comprising a bottom plate 12, a top plate 11, a side plate 13 on the blower compartment side, a side plate 14 on the machine compartment side, a blower compartment-side front plate 15, and a machine compartment-side front plate 16. The top plate 11 is a plate-shaped member made of a steel sheet, constituting the roof surface portion of the unit casing 10. The bottom plate 12 is a plate-shaped member made of a steel sheet, constituting the floor surface portion of the unit casing 10. Provided on the underside of the bottom plate 12 are two foundation legs 19 fixed to the onsite installation surface. The side plate 13 on the blower compartment side is a plate-shaped member made of a steel sheet, constituting the side surface portion of the unit casing 10 near the blower compartment S1. The machine compartment-side side plate 14 is a plate-shaped member made of a steel sheet, constituting a part of the side surface portion of the unit casing 10 near the machine compartment S2, and the back surface portion of the unit casing 10 near the machine compartment S2. The blower compartment-side front plate 15 is a plate-shaped member made of a steel sheet, constituting the front surface portion of the blower compartment S1 of the unit casing 10, and a part of the front surface portion of the machine compartment S2 of the unit casing 10.

The outside air conditioning unit 2 is configured so that outside air is drawn into the blower compartment S1 of the unit casing 110 through the back surface and a part of the side surface of the unit casing 10, and the drawn-in outside air is blown out through the front surface of the unit casing 10. Therefore, an intake port 10*a* for outside air drawn into the blower compartment S1 in the unit casing 10 is formed between the back surface end of the side plate 13 on the blower compartment side and the blower compartment S1-side end of the side plate 14, and an intake port 10*b* for outside air is formed in the side plate 13 on the blower compartment side. A blow-out port 10*c* for blowing outside air drawn into the blower compartment S1 out to the exterior is provided in the blower compartment-side front plate 15. The front side of the blow-out port 10*c* is covered by a fan grill 15*a*.

The compressor 91 is a hermetic compressor driven by a compressor motor, for example, and is configured so that the operation capacity can be varied. The compressor 91 is disposed in the machine compartment S2.

The four-way valve 92 is a mechanism for switching the direction of refrigerant flow. During the cooling operation, the four-way valve 92 connects the refrigerant line on the discharge side of the compressor 91 and one end of the outdoor heat exchanger 20, and also connects the gas-refrigerant-side shutoff valve 95 and the refrigerant line on the intake side of the compressor 91 via the accumulator 93 (refer to the solid lines of the four-way valve 92 in FIG. 1). During the heating operation, the four-way valve 92 connects the refrigerant line on the discharge side of the compressor 91 and the gas-refrigerant-side shutoff valve 95, and also connects a compressor intake-side line 29*a* and one end of the outdoor heat exchanger 20 via the accumulator 93 (refer to the broken lines of the four-way valve 92 in FIG. 1).

The outdoor heat exchanger 20 is disposed upright (vertically) in the blower compartment S1, facing the intake ports 10*a*, 10*b*. The outdoor heat exchanger 20 is an aluminum heat exchanger. In order to prevent corrosion, the aluminum outdoor heat exchanger 20 is attached to the unit casing 10 so as to not be in direct contact with components made of steel sheets, such as the top plate 11, the bottom plate 12, the side plate 13 on the blower compartment side, and the machine compartment-side side plate 14. One end of the outdoor heat exchanger 20 is connected to the four-way valve 92, and the other end is connected to the expansion valve 40.

The accumulator 93 is disposed in the machine compartment S2, and is connected between the four-way valve 92 and the compressor 91. The accumulator 93 is equipped with a gas-liquid separation function for separating the refrigerant into gas-phase refrigerant and liquid-phase refrigerant. Refrigerant flowing into the accumulator 93 is separated into liquid-phase refrigerant and gas-phase refrigerant, and the gas-phase refrigerant collecting in an upper space being supplied to the compressor 91.

The outdoor unit 2 has the outdoor fan 70 for drawing outside air into the unit and discharging the air back out of the room. The outdoor fan 70 causes heat exchange between the outside air and the refrigerant flowing through the outdoor heat exchanger 20. The expansion valve 40, which is a mechanism for depressurizing refrigerant in the refrigeration circuit, is an electric valve of which the opening degree can be adjusted. The expansion valve 40 is provided to the gas refrigerant pipe 41 between the outdoor heat exchanger 20 and a liquid-refrigerant-side shutoff valve 37 in order to adjust refrigerant pressure and/or refrigerant flow rate, and the expansion valve has the function of expanding the refrigerant during both the cooling operation and the heating operation.

The outdoor fan 70 is arranged in the blower compartment S1, facing the outdoor heat exchanger 20. The outdoor fan 70 draws outside air into the unit, causes heat exchange between refrigerant and the outside air in the outdoor heat exchanger 20, and then discharges the air to the outside after the heat exchange. The outdoor fan 70 is a fan capable of varying airflow supplied to the outdoor heat exchanger 20; for example, a propeller fan or the like, driven by a motor composed of a DC fan motor or the like.

(3-2-1) Outdoor Heat Exchanger

Figure 4:
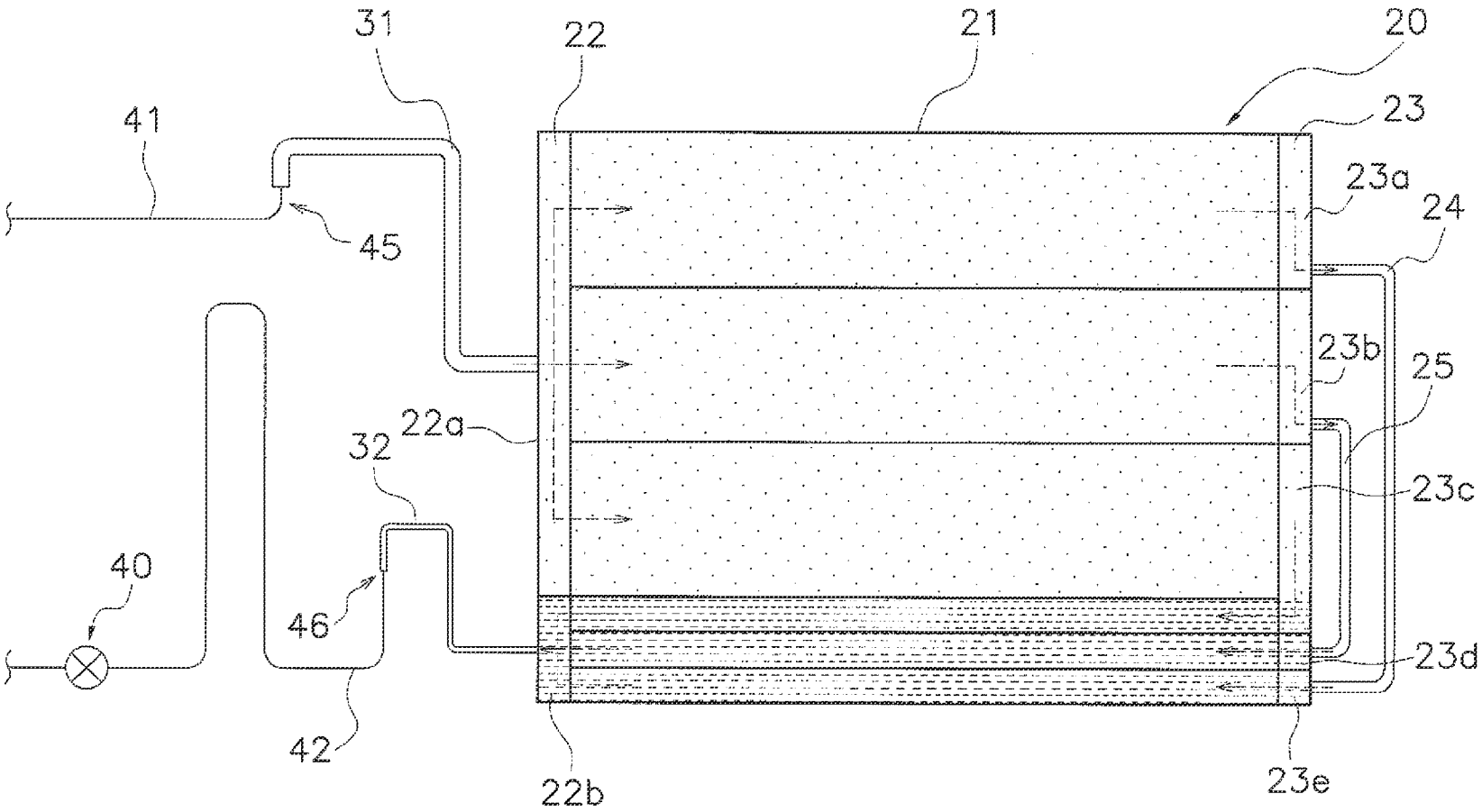
FIG. 4 is a schematic rear view showing the summarized configuration of the outdoor heat exchanger.
Figure 5:
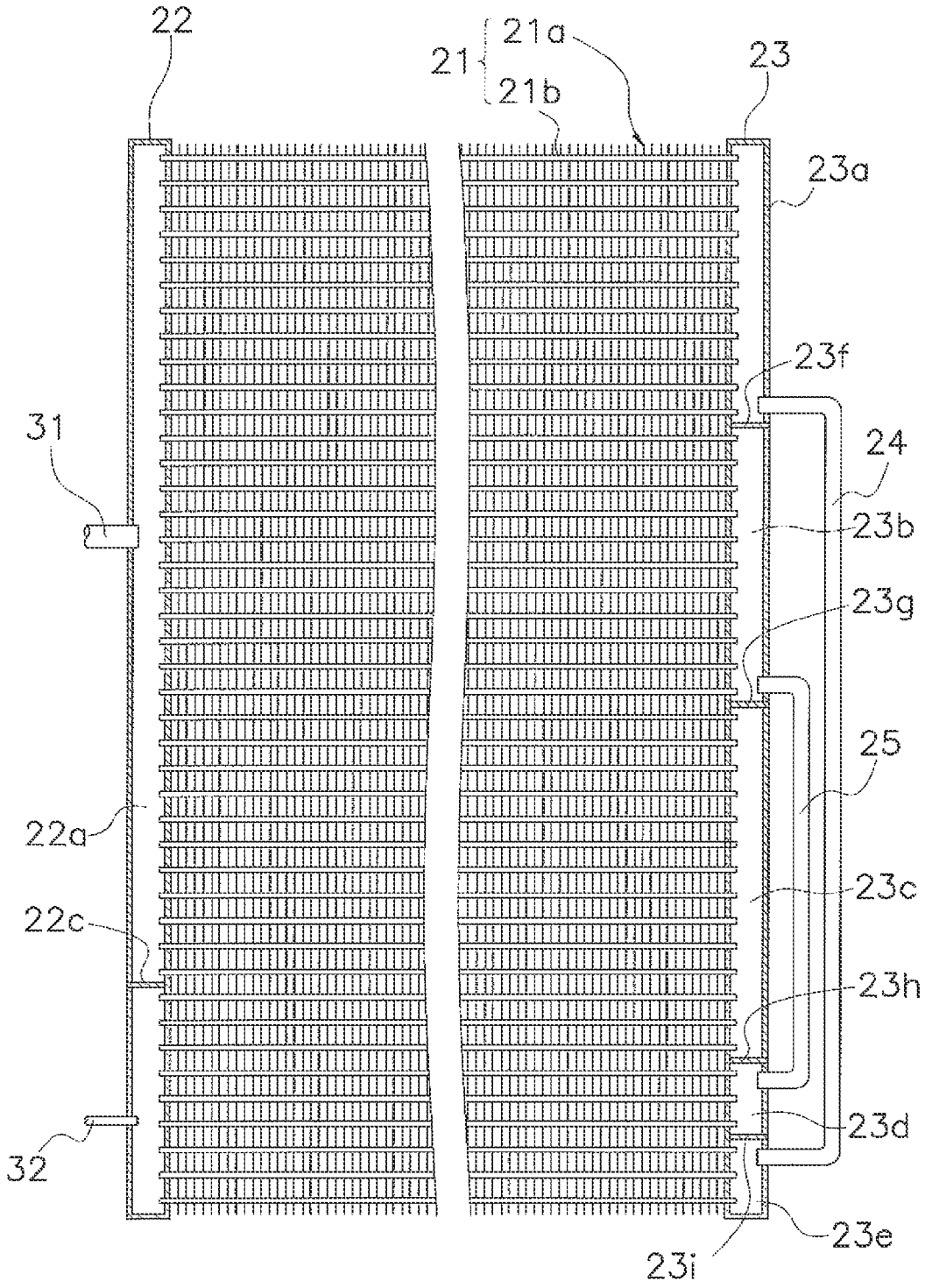
FIG. 5 is a partial enlarged cross-sectional view for describing the configuration of the outdoor heat exchanger.

Next, FIGS. 4 and 5 are used to give a detailed description of the configuration of the outdoor heat exchanger 20, the piping connected to the outdoor heat exchanger 20, and the like.

The outdoor heat exchanger 20 comprises a heat exchange part 21 for performing heat exchange between outside air and refrigerant, this heat exchange part 21 being configured from numerous aluminum heat transfer fins 21*a* and numerous aluminum flat multi-hole tubes 21*b*. The flat multi-hole tubes 21*b* function as heat transfer tubes through which heat energy transfers between the heat transfer fins 21*a* and the outside air is transmitted to the refrigerant flowing through the interior.

The outdoor heat exchanger 20 comprises aluminum header pipes 22, 23, each provided to either end of the heat exchange part 21. The header pipe 22 has internal spaces 22*a*, 22*h* partitioned from each other by a baffle 22*c*. The aluminum heat-exchanger-side gas pipe 31 is connected to the upper internal space 22*a*, and the aluminum heat-exchanger-side liquid pipe 32 is connected to the lower internal space 22*b*.

The header pipe 23 is partitioned by baffles 23*f*, 23*g*, 23*h*, 23*i*, and internal spaces 23*a*, 23*b*, 23*c*, 23*d*, 23*e* are formed. The numerous flat multi-hole tubes 21*b* connected to the upper internal space 22*a* of the header pipe 22 are connected to the three internal spaces 23*a*, 23*b*, 23*c* of the header pipe 23. The numerous flat multi-hole tubes 21*b* connected to the lower internal space 22*b* of the header pipe 22 are connected to the three internal spaces 23*c*, 23*d*, 23*e* of the header pipe 23.

The internal space 23*a* and the internal space 23*e* of the header pipe 23 are connected by a communication piping 24, and the internal space 23*b* and the internal space 23*d* are connected by a communication piping 25. The internal space 23*c* also has the function of connecting a part of the upper part (the portion connected to the internal space 22*a*) of the heat exchange part 21 and a part of the lower part (the portion connected to the internal space 22*b*). With these configurations, during the cooling operation for example, the gas refrigerant supplied by the aluminum heat-exchanger-side gas pipe 31 to the internal space 23*a* at the top of the header pipe 23 undergoes heat exchange in the upper part of the heat exchange part 21, and the gas refrigerant is liquefied. The gas refrigerant turns back at the header pipe 23, passes through the lower part of the heat exchange part 21, and exits the aluminum heat-exchanger-side liquid pipe 32.

The aluminum heat-exchanger-side gas pipe 31 is connected to the copper gas refrigerant pipe 41 in a connecting part 45 in order to furnish the piping inside the unit casing 10. The aluminum heat-exchanger-side liquid pipe 32 is connected to the copper liquid refrigerant pipe 42 in a connecting part 46 in order to finish the piping inside the unit casing 10.

As previously described, the outdoor heat exchanger 20, for which aluminum and/or an aluminum alloy is used, is an aluminum heat exchanger; therefore, the primary material constituting the aluminum heat transfer fins 21*a*, the aluminum flat multi-hole tubes 21*b*, and the aluminum header pipes 22, 23 is aluminum or an aluminum alloy.

(3-2-2) Heat Exchange Part

Figure 6:
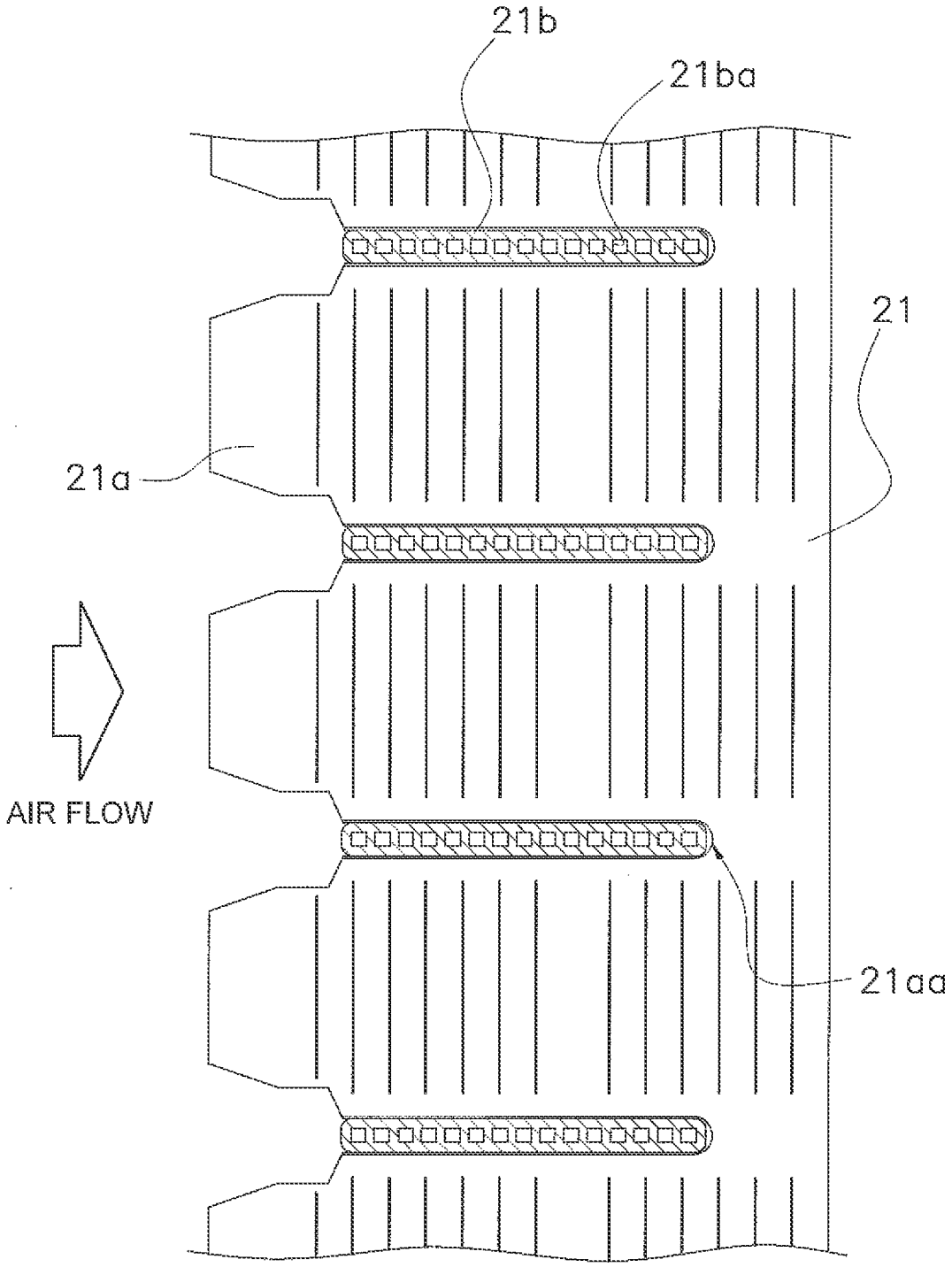
FIG. 6 is a partial enlarged cross-sectional view for describing the configuration of the heat exchange part of the outdoor heat exchanger.

FIG. 6 is a partial enlarged view showing a cross-sectional structure in a plane perpendicular to the flat multi-hole tubes 21*b* of the heat exchange part 21 of the outdoor heat exchanger 20. The heat transfer fins 21*a* are thin aluminum flat plates, and formed in each heat transfer fin 21*a* is a plurality of notches 21*aa* extending horizontally and aligned vertically. Each flat multi-hole tube 21*b* has upper and lower flat surface parts that serve as the heat transfer surfaces, and a plurality of internal flow channels 21*ba* through which refrigerant flows. The flat multi-hole tubes 21*b*, which are slightly thicker than the vertical width of the notches 21*aa*, are spaced apart and arrayed in multiple tiers with the flat surface parts facing up and down, and are temporarily fixed in a state of being fitted into the notches 21*aa*. Thus, the heat transfer fins 21*a* and the flat multi-hole tubes 21*b* are soldered with the flat multi-hole tithes 21*b* fitted into the notches 21*aa* of the heat transfer fins 21*a*. The two ends of each flat multi-hole tube 21*b* are fitted in and soldered to the respective header pipes 22, 23. Therefore, the internal spaces 22*a*, 22*b* of the header pipe 22 and/or the internal spaces 23*a*, 23*b*, 23*c*, 23*d*, 23*e* of the header pipe 23 are linked to the internal flow channels 21*b* a of the flat multi-hole tubes 21*h*.

Because the heat transfer fins 21*a* are linked vertically as depicted in FIG. 6, dew water occurring on the heat transfer fins 21*a* and/or the flat multi-hole tubes 21*b* drips down along the heat transfer fins 21*a*, passes through the channels formed in the bottom plate 12, and is expelled to the outside. Due to such a structure, water droplets forming on the heat exchange part 21 can be prevented from reaching the copper gas refrigerant pipe 41 and/or copper liquid refrigerant pipe 42 from the heat exchange part 21 via the header pipes 22, 23, the heat-exchanger-side gas pipe 31, and/or the heat-exchanger-side liquid pipe 32.

(3-2-3) Heat-Exchanger-Side Gas Pipe, Heat-Exchanger-Side Liquid Pipe, and Peripheral Structure Thereof.

Figure 7:
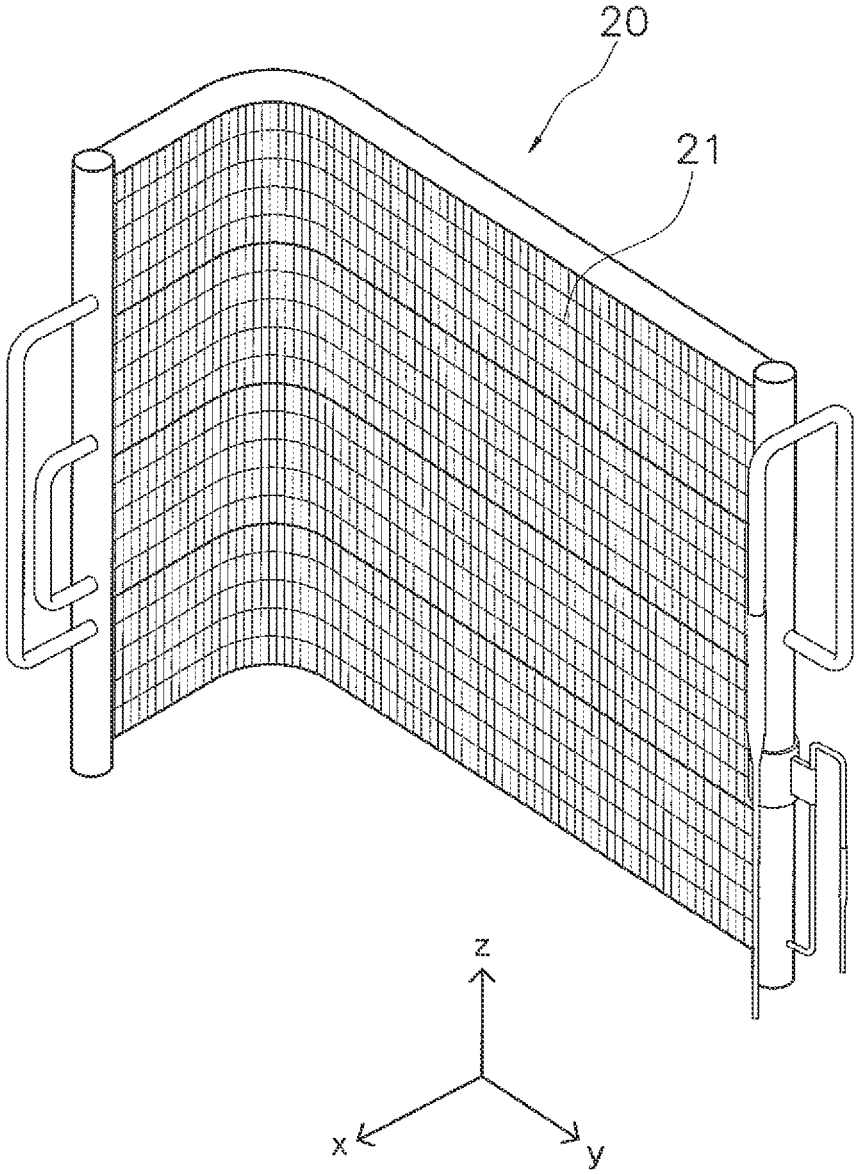
FIG. 7 is a perspective view showing the outdoor heat exchanger, the heat-exchanger-side gas pipe, and the heat-exchanger-side liquid pipe.
Figure 8:
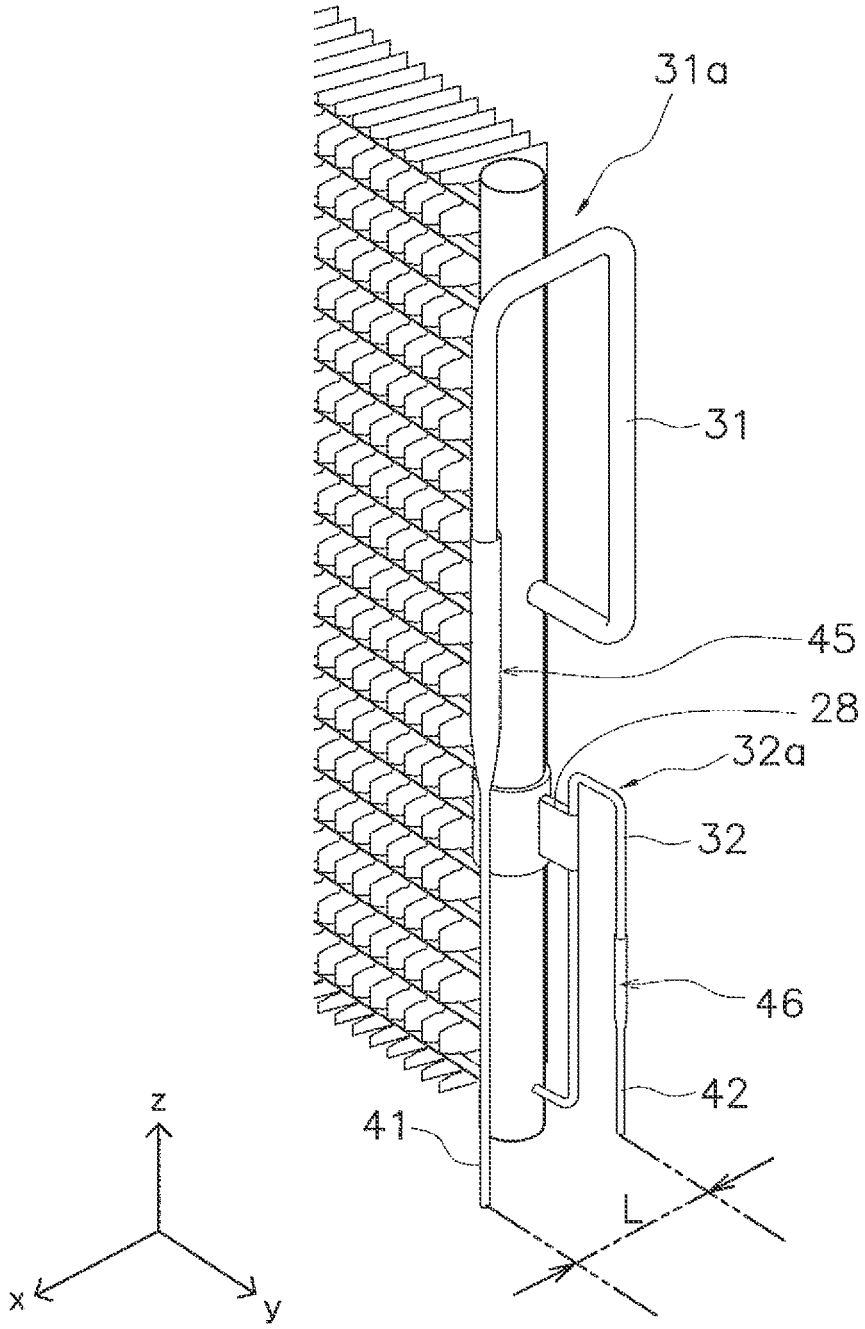
FIG. 8 is a partial enlarged perspective view showing the outdoor heat exchanger, the heat-exchanger-side gas pipe, and the heat-exchanger-side liquid pipe.

FIG. 7 is a perspective view for describing the placement of the aluminum outdoor heat exchanger 20, as well as the aluminum heat-exchanger-side gas pipe 31, the aluminum heat-exchanger-side liquid pipe 32, the copper gas refrigerant pipe 41, and the copper liquid refrigerant pipe 42 extending from the outdoor heat exchanger 20. FIG. 8 is a partial enlarged perspective view in which the periphery of the header pipe 22, which is on one side of the outdoor heat exchanger 20, is enlarged.

The aluminum heat-exchanger-side gas pipe 31 is brazed to the middle of the upper part (the location of the internal space 22*a*) of the aluminum header pipe 22 (on one side of the outdoor heat exchanger 20), and the aluminum heat-exchanger-side liquid pipe 32 is brazed to the middle of the lower part (the location of the internal space 22*b*). The heat-exchanger-side gas pipe 31 and the heat-exchanger-side liquid pipe 32 extend in the same direction from the header pipe 22. In other words, the heat-exchanger-side gas pipe 31 and the heat-exchanger-side liquid pipe 32 extend from the header pipe 22 in a direction parallel to the direction in which the flat multi-hole tubes 21*b* extend in the proximity of the header pipe 22 (sometimes referred to as a y-axis direction in the following description).

The heat-exchanger-side liquid pipe 32 extends in the y-axis direction out of the header pipe 22, then rises perpendicularly and extends upward. In the following description, the vertical direction is sometimes referred to as a z-axis direction. The heat-exchanger-side liquid pipe 32 extending in the z-axis direction is supported by an aluminum bracket 28 attached to the header pipe 22. The heat-exchanger-side liquid pipe 32 turns back in the y-axis direction after having passed through the bracket 28, i.e. at a position lower than the position where the heat-exchanger-side gas pipe 31 is connected to the header pipe 22. After extending slightly in the y-axis direction, the heat-exchanger-side liquid pipe 32 bends downward in the z-axis direction. The end of the heat-exchanger-side liquid pipe 32 is in a location that is lower by a distance smaller than the rising height of the heat-exchanger-side liquid pipe 32. The copper liquid refrigerant pipe 42 is soldered and connected to the end of the aluminum heat-exchanger-side liquid pipe 32. In other words, the end of the heat-exchanger-side liquid pipe 32 constitutes a part of the connecting part 46 of the heat-exchanger-side liquid pipe 32 and the liquid refrigerant pipe 42. Thus, the heat-exchanger-side liquid pipe 32 has a turn-back part 32*a* having a structure that rises in the z-axis direction, proceeds in the y-axis direction, and then falls back down in the z-axis direction.

The heat-exchanger-side gas pipe 31 extends in the y-axis direction out of the header pipe 22, then rises in the z-axis direction at substantially the same position as the position where the heat-exchanger-side liquid pipe 32 rises. The gas pipe then bends forward at a position lower than the top end portion of the heat exchange part 21. In the following description, the forward-backward direction perpendicular to the y-axis direction and the z-axis direction is sometimes referred to as an x-axis direction. The heat-exchanger-side gas pipe 31 falls in the z-axis direction after having slightly extended in the x-axis direction. The end of the gas pipe is in a position higher than the heat-exchanger-side liquid pipe 32. The copper gas refrigerant pipe 41 is brazed and connected to the end of the aluminum heat-exchanger-side gas pipe 31. In other words, the end of the heat-exchanger-side gas pipe 31 constitutes a part of the connecting part 45 of the heat-exchanger-side gas pipe 31 and the gas refrigerant pipe 41. Thus, the heat-exchanger-side gas pipe 31 has a turn-back part 31*a* that rises in the z-axis direction, proceeds in the x-axis direction, and then falls back down in the z-axis direction.

Figure 9:
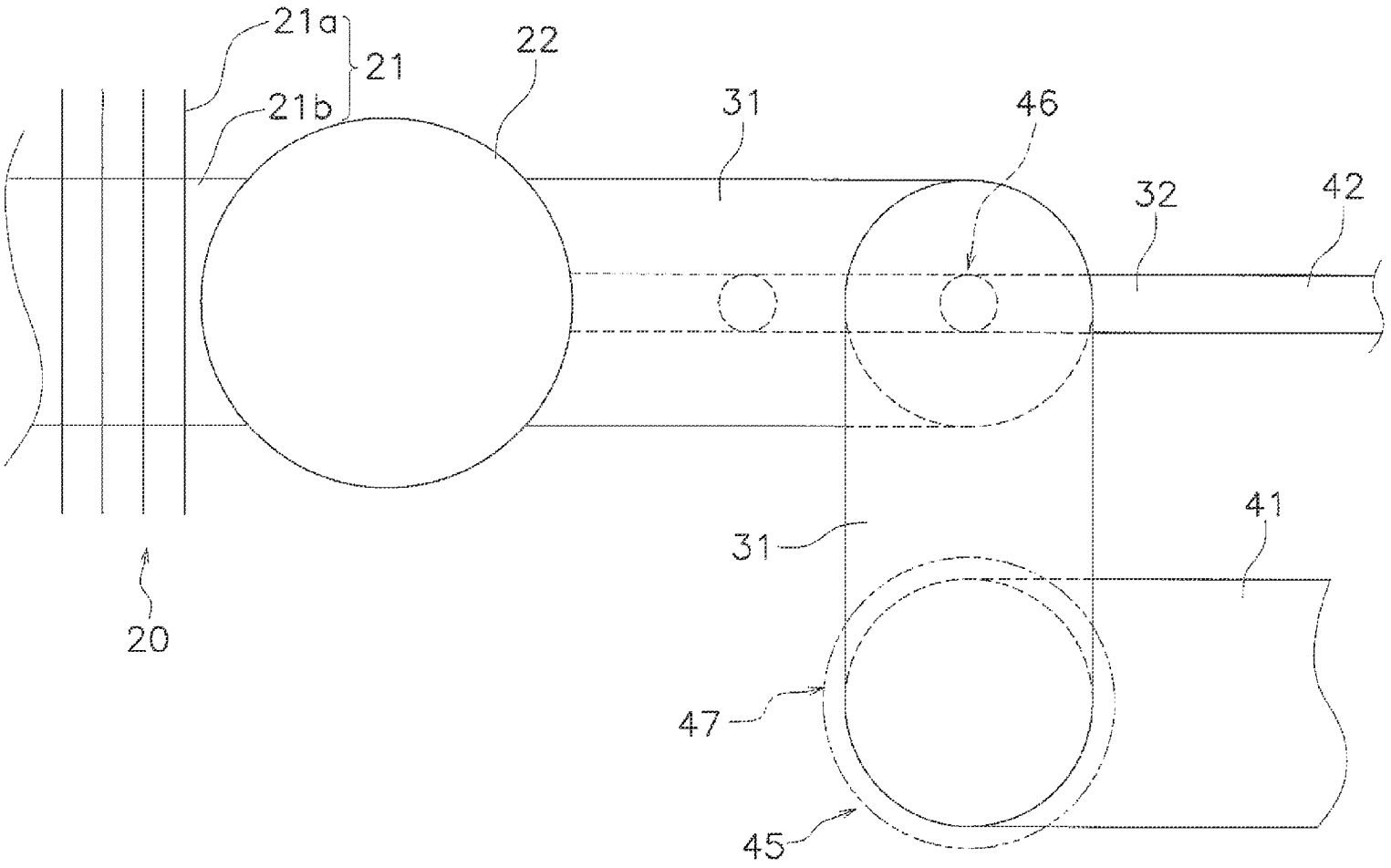
FIG. 9 is a partial enlarged plan view for describing the placement of the heat-exchanger-side gas pipe and the heat-exchanger-side liquid pipe.

In a plan view, the turn-back part 32*a* of the heat-exchanger-side liquid pipe 32 is disposed in an orientation orthogonal to the turn-back part 31*a* of the heat-exchanger-side gas pipe 31, as depicted in FIG. 9. This creates a structure in which the axes are separated from each other by a distance L as depicted in FIG. 8, and the heat-exchanger-side liquid pipe 32 is disposed in an area outside of an area 47 directly below the connecting part 45 of the heat-exchanger-side gas pipe 31 and the gas refrigerant pipe 41. The turn-back part 31*a* and the turn-back part 32*a* do not essential to be orthogonal in order to dispose the heat-exchanger-side liquid pipe 32 in an area outside of the area 47 directly below the connecting part 45, and the turn-back parts may intersect at a predetermined angle. The predetermined angle is preferably about 90 degrees in order to make the piping space compact.

(4) Characteristics of Air Conditioning Apparatus (4-1)

In the air conditioning apparatus 1, when dew condensation forms on the copper gas refrigerant pipe 41 (the copper gas pipe) during the heating operation, for example, copper ions seep into the dew condensation water from the gas refrigerant pipe 41, and dew condensation water containing copper ions accumulates on the surface of the gas refrigerant pipe 41. However, because the aluminum heat-exchanger-side gas pipe 31 (aluminum gas pipe) is connected from above the gas refrigerant pipe 41, dew condensation water on the surface of the gas refrigerant pipe 41 below does not move toward the heat-exchanger-side gas pipe 31 above. Therefore, dew condensation water containing copper ions that has formed by dew condensation on the copper gas refrigerant pipe 41 does not get on the aluminum heat-exchanger-side gas pipe 31.

The aluminum heat-exchanger-side liquid pipe 32 positioned lower than the copper gas refrigerant pipe 41 is not disposed in the area 47 directly below the connecting part 45 of the heat-exchanger-side gas pipe 31 and the gas refrigerant pipe 41. The connecting part 45 has many concavities and convexities for connection and dew condensation water containing copper ions readily drips down from the connecting part 45, but the dripping dew condensation water does not readily get on the aluminum heat-exchanger-side liquid pipe 32. This prevents the progress of corrosion of the aluminum heat-exchanger-side liquid pipe 32 caused by dew condensation water containing copper ions forming on the copper gas refrigerant pipe 41.

In the above embodiment, a case was described in which the heat-exchanger-side gas pipe 31 and the gas refrigerant pipe 41 extended vertically (extended in the z-axis direction) from the top and bottom of the connecting part 45, and the area 47 directly below the connecting part 45 therefore substantially overlapped the position of the connecting part 45 in a plan view. However, depending on how the placement and/or piping of the various devices are handled, there are cases in which the gas refrigerant pipe 41 extends from the connecting part 45 at a predetermined angle relative to the z-axis direction. In such cases, the area where the gas refrigerant pipe 41 is projected is also included in the area directly below the connecting part 45 in a plan view because dew condensation water sometimes runs down the gas refrigerant pipe 41.

The pipes for gas refrigerant that overlap with the aluminum heat-exchanger-side liquid pipe 32 in a plan view are all preferably made of aluminum. This is because though dew condensation may occur on the aluminum pipes for gas refrigerant, it is aluminum ions that are included in the dew condensation water, and the effects of promoting corrosion in the aluminum heat-exchanger-side liquid pipe 32 are therefore extremely small compared to the same effects of copper ions.

(4-2)

In the air conditioning apparatus 1 described above, the turn-back part 32*a* (first turn-back part) is provided to the aluminum heat-exchanger-side liquid pipe 32 extending from the header pipe 22. Therefore, even if water droplets spread over the copper liquid refrigerant pipe 42, the progression of water droplets is stopped by the turn-back part 32*a* because there is a location where a pipe rises in the z-axis direction in the path of the water droplets, due to the turn-back part 32*a* of the aluminum heat-exchanger-side liquid pipe 32. As a result, it is possible to prevent corrosion of the aluminum outdoor heat exchanger 20 by water containing copper ions collecting on the copper liquid refrigerant pipe 42.

(4-3)

In the air conditioning apparatus 1 described above, the heat-exchanger-side gas pipe 31 and the heat-exchanger-side liquid pipe 32 extend in the same direction (the y-axis direction), but the turn-back part 31*a* (the second turn-back part) of the heat-exchanger-side gas pipe 31 extends in the x-axis direction, the turn-back part 32*a* (the first turn-back part) of the heat-exchanger-side liquid pipe 32, extends in the y-axis direction, and the two turn-back parts are disposed at orientations orthogonal to each other in a plan view.

Because the aluminum heat-exchanger-side gas pipe 31 must be connected to the copper gas refrigerant pipe 41 from above and the aluminum heat-exchanger-side liquid pipe 32 must be connected to the copper liquid refrigerant pipe 42 from above, the space needed for the piping tends to be large. However, due to the turn-back part 31*a* of the heat-exchanger-side gas pipe 31 and the turn-back part 32*a* of the heat-exchanger-side liquid pipe 32 thus being disposed in intersecting orientations, the disposed position of the aluminum heat-exchanger-side liquid pipe 32 can be shifted out of the area 47 directly below the connecting part 45 without taking up much space, while turning the two parts back and keeping them within the range of the height (the vertical length) of the heat exchanger. Thus, the periphery of the outdoor heat exchanger 20 and consequently the vertical direction of the outdoor unit 2 can be made more compact while preventing corrosion of the aluminum heat-exchanger-side liquid pipe 32.

(4-4)

In the air conditioning apparatus 1 described above, the aluminum outdoor heat exchanger 20 is configured comprising the numerous aluminum flat multi-hole tubes 21*b* (flat pipes) arrayed so as to face each other, the aluminum header pipes 22, 23 to which the numerous flat multi-hole tubes 21*b* are connected, and the numerous heat transfer fins 21*a* (fins) bonded to the numerous flat multi-hole tubes.

The heat-exchanger-side gas pipe 31 is connected to the middle of the internal space 22*a* of the header pipe 22 (the middle vicinity of the upper part of the header pipe), as depicted in FIG. 4. Therefore, gas refrigerant entering the internal space 22*a* of the header pipe 22 from the heat-exchanger-side gas pipe 31 spreads uniformly up and down, and flows into the upper part of the heat exchange part 21 from the header pipe 22. Therefore, drift of refrigerant flow in the outdoor heat exchanger 20 is unlikely. When the gas refrigerant is flowing in the opposite direction, i.e. when the refrigerant flows from the header pipe 22 toward the heat-exchanger-side gas pipe 31, the drift of refrigerant flow is similarly suppressed.

(5) Modifications (5-1) Modification A

In the air conditioning apparatus 1 of the above embodiment, a case was described in which the configuration was designed such that the heat-exchanger-side gas pipe 31 and the heat-exchanger-side liquid pipe 32 extended in the same y-axis direction from the header pipe 22 as depicted in FIG. 9, but the configuration may be designed such that the heat-exchanger-side gas pipe 31 and the heat-exchanger-side liquid pipe 32 extend in different directions, whereby the heat-exchanger-side liquid pipe 32 is disposed outside of the area 47 directly below the connecting part 45. The configuration can also be designed so that in a plan view. For example, the heat-exchanger-side gas pipe 31 extends from the header pipe 22 at a tilt toward the front surface at a predetermined angle relative to the y-axis direction, and the heat-exchanger-side liquid pipe 32 extends from the header pipe 22 at a tilt toward the rear surface at a predetermined angle relative to the y-axis direction.

(5-2) Modification B

In the above embodiment, a case was described in which there is one heat-exchanger-side gas pipe 31 and one heat-exchanger-side liquid pipe 32, but the configuration may be provided with a plurality of either one or both the heat-exchanger-side gas pipe 31 and the heat-exchanger-side liquid pipe 32.

(5-3) Modification C

In the above embodiment, only the aluminum heat-exchanger-side gas pipe 31 and the aluminum heat-exchanger-side liquid pipe 32 are provided between the gas refrigerant pipe 41 and the header pipe 22 and between the liquid refrigerant pipe 42 and the header pipe, but another component such as a flow diverter may also be provided. When such a configuration is adopted, the flow diverter is regarded as an extension of the length of the heat-exchanger-side gas pipe and/or the heat-exchanger-side liquid pipe, and the locations where the flow diverter and the copper gas refrigerant line and/or liquid refrigerant line are connected are the connecting parts.

What is claimed is:

1. An air conditioning apparatus comprising:

an aluminum heat exchanger configured to perform heat exchange between air and a refrigerant, the aluminum heat exchanger being disposed upright;

an aluminum gas pipe configured and arranged to channel gas refrigerant, the aluminum gas pipe extending from a side part of the aluminum heat exchanger;

an aluminum liquid pipe configured and arranged to channel liquid refrigerant, the aluminum liquid pipe extending from an area below the aluminum gas pipe in the side part of the aluminum heat exchanger;

a copper gas pipe configured and arranged to channel gas refrigerant; and a copper liquid pipe configured and arranged to channel liquid refrigerant, the aluminum gas pipe being connected in a connecting part to the copper gas pipe from above the copper gas pipe, the aluminum liquid pipe being disposed in an area outside of directly connecting part of the aluminum gas pipe and the copper gas pipe, the aluminum liquid pipe having a first turn-back part extending upward from the side part of the aluminum heat exchanger and then forming a U-turn to extend downward, and the copper liquid pipe being connected to an end of the first turn-back part from below.

2. The air conditioning apparatus according to claim 1, wherein the aluminum gas pipe extends along a direction in which the aluminum liquid pipe extends, and the aluminum gas pipe has a second turn-back part extending upward from the side part of the aluminum heat exchanger and then forming a U-turn to extend downward, the copper gas pipe is connected to an end of the second turn-back part from below, and the second turn-back part is disposed in an orientation that intersects the first turn-back part as seen in a plan view.

3. The air conditioning apparatus according to claim 1, wherein the aluminum heat exchanger has a plurality of aluminum flat pipes, an aluminum header pipe to which the flat pipes are connected, and a plurality of aluminum fins bonded to the flat pipes, with the aluminum heat exchanger being configured so that fluid flowing inside the flat pipes exchanges heat with air flowing over the exterior of the flat pipes, the aluminum gas pipe is connected to a middle vicinity of a top part of the header pipe, and the aluminum liquid pipe is connected to a bottom part of the header pipe.

4. The air conditioning apparatus according to claim 2, wherein the aluminum heat exchanger has a plurality of aluminum flat pipes, an aluminum header pipe to which the flat pipes are connected, and a plurality of aluminum fins bonded to the flat pipes, with the aluminum heat exchanger being configured so that fluid flowing inside the flat pipes exchanges heat with air flowing over the exterior of the flat pipes, the aluminum gas pipe is connected to a middle vicinity of a top part of the header pipe, and the aluminum liquid pipe is connected to a bottom part of the header pipe.

* * * * *